US011014783B2

(12) United States Patent
Davis

(10) Patent No.: US 11,014,783 B2
(45) Date of Patent: May 25, 2021

(54) PROTECTIVE SLEEVE FOR ELEVATOR BELT

(71) Applicant: Otis Elevator Company, Farmington, CT (US)

(72) Inventor: Danielle Davis, East Granby, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 582 days.

(21) Appl. No.: 15/891,661

(22) Filed: Feb. 8, 2018

(65) Prior Publication Data

US 2019/0241401 A1 Aug. 8, 2019

(51) Int. Cl.

| | |
|---|---|
| ***B66B 7/02*** | (2006.01) |
| ***B66B 7/06*** | (2006.01) |
| ***B66B 7/10*** | (2006.01) |
| ***B66B 5/00*** | (2006.01) |
| ***B66B 7/12*** | (2006.01) |

(52) U.S. Cl.

CPC ..... *B66B 7/027* (2013.01); *B66B 5/0087* (2013.01); *B66B 7/06* (2013.01); *B66B 7/062* (2013.01); *B66B 7/068* (2013.01); *B66B 7/10* (2013.01); *B66B 7/1223* (2013.01)

(58) Field of Classification Search

CPC .... B66B 7/1276; B66B 7/1284; B66B 7/1215
See application file for complete search history.

(56) References Cited

U.S. PATENT DOCUMENTS

| | | | | |
|---|---|---|---|---|
| 4,058,186 | A | 11/1977 | Mullis | |
| 4,071,124 | A | 1/1978 | Price | |
| H702 | H | 11/1989 | Shively et al. | |
| 5,080,199 | A | 1/1992 | McCallum, III | |
| 5,086,880 | A | 2/1992 | Pearce | |
| 5,520,264 | A * | 5/1996 | Korhonen | B66B 7/02 187/408 |
| 6,234,277 | B1 * | 5/2001 | Kaczmarek | B66B 7/06 174/42 |
| 6,364,575 | B1 | 4/2002 | Bradley et al. | |
| 6,481,537 | B1 | 11/2002 | Malone, Jr. et al. | |
| 6,786,306 | B2 | 9/2004 | Tiner | |
| 7,393,157 | B1 | 7/2008 | Macias | |
| 8,438,803 | B2 | 5/2013 | Turner | |

(Continued)

FOREIGN PATENT DOCUMENTS

| | | |
|---|---|---|
| CN | 1990371 A | 7/2007 |
| CN | 103991772 A | 8/2014 |

(Continued)

OTHER PUBLICATIONS

Machine Translation of Jph 4-109975.*

(Continued)

*Primary Examiner* — Diem M Tran

(74) *Attorney, Agent, or Firm* — Cantor Colburn LLP

(57) ABSTRACT

A protective cover for a load bearing member of an elevator system includes a sleeve wrapped around a perimeter of the load bearing member, the sleeve configured to protect the load bearing member from debris damage during installation or maintenance operation of the elevator system, and configured to slide along a length direction of the load bearing member. A tether is configured to connect the sleeve to a working platform.

16 Claims, 6 Drawing Sheets

(56) References Cited

U.S. PATENT DOCUMENTS

| | | | | |
|---|---|---|---|---|
| 8,562,029 | B2 | 10/2013 | Louvain-Walters et al. | |
| 9,758,344 | B2 | 9/2017 | Fauconnet et al. | |
| 2005/0189176 | A1 | 9/2005 | Demeyer et al. | |
| 2009/0301822 | A1 | 12/2009 | Keszthelyi | |
| 2011/0100759 | A1* | 5/2011 | Yu | C09D 5/185 187/251 |
| 2013/0306792 | A1 | 11/2013 | Jefferson et al. | |
| 2016/0083223 | A1 | 3/2016 | Altenburger | |
| 2019/0270614 | A1* | 9/2019 | Kato | B08B 1/005 |

FOREIGN PATENT DOCUMENTS

| | | | | |
|---|---|---|---|---|
| JP | 04109975 | U | | 9/1992 |
| JP | 09-012247 | A | * | 1/1997 |
| JP | 2005162372 | A | | 6/2005 |
| JP | 2006193257 | A | | 7/2006 |
| JP | 2007276991 | A | | 10/2007 |
| JP | 2008030898 | A | | 2/2008 |
| JP | 2010189146 | A | | 9/2010 |
| JP | 2016060551 | A | | 4/2016 |

OTHER PUBLICATIONS

English Machine Translation of JPH 09-012247.*
European Search Report Issued in EP Application No. 19156212.3, dated Jun. 21, 2019, 8 Pages.
Chinese Office Action for Chinese Application No. 201910110137.5, dated Apr. 20, 2020, 27 pages.

* cited by examiner

PROTECTIVE SLEEVE FOR ELEVATOR BELT

BACKGROUND

Exemplary embodiments pertain to the art of elevator systems. More particularly, the present disclosure relates to installation and maintenance of elevator systems.

Elevator systems are useful for carrying passengers, cargo, or both, between various levels in a building. Some elevators are traction based and utilize load bearing members such as belts for supporting the elevator car and achieving the desired movement and positioning of the elevator car.

In installation of some elevator systems, a scaffold is used to install components in the hoistway, such as rails, controllers and the like. Then, the elevator car and load bearing members are installed thus completing installation of the elevator system. With high rise systems, in particular, installation and use of scaffolding for elevator system component installation in the hoistway can be cumbersome and inefficient.

In other configurations, the drive system of the elevator system, such as the machine and the load bearing members are installed in the hoistway and connected to the elevator car. The elevator car, or a dedicated installation car, are utilized as an installation platform to install the remaining components in the hoistway. Starting at the bottom, or alternatively the top, of the hoistway, components such as rail sections are installed from the installation platform at a first location. The installation platform is then moved along the hoistway via the machine and load bearing members to this first location and the elevator system components are installed at a second location from the installation platform. This movement and installation continues along the hoistway.

The installation mechanics conduct operations such as welding and grinding at the installation platform to install rails and other components. With such operations taking place in close proximity to the load bearing members, the load bearing members are exposed to, for example, weld slag, concrete debris, and other construction materials that can damage the load bearing members.

BRIEF DESCRIPTION

In one embodiment, a protective cover for a load bearing member of an elevator system includes a sleeve wrapped around a perimeter of the load bearing member, the sleeve configured to protect the load bearing member from debris damage during installation or maintenance operation of the elevator system, and configured to slide along a length direction of the load bearing member. A tether is configured to connect the sleeve to a working platform.

Additionally or alternatively, in this or other embodiments a closure secures the sleeve at the load bearing member.

Additionally or alternatively, in this or other embodiments the closure is one of a hook and loop fastener, a button, a snap, a magnet, or a tie.

Additionally or alternatively, in this or other embodiments the sleeve is formed of a non-flammable fabric.

Additionally or alternatively, in this or other embodiments the tether includes a breakaway feature.

Additionally or alternatively, in this or other embodiments the breakaway feature is a breakaway buckle.

In another embodiment, an elevator system includes a hoistway, an elevator car located in the hoistway, an elevator load bearing member operably connected to the elevator car to suspend and/or drive the elevator car along the hoistway, and a guide rail installed in the hoistway to guide movement of the elevator car along the hoistway. A protective cover for the load bearing member includes a sleeve wrapped around a perimeter of the load bearing member. The sleeve is configured to protect the load bearing member from debris damage during installation or maintenance operation of the elevator system, and configured to slide along a length direction of the load bearing member. A tether is configured to connect the sleeve to the elevator car.

Additionally or alternatively, in this or other embodiments a closure secures the sleeve at the load bearing member.

Additionally or alternatively, in this or other embodiments the closure is one of a hook and loop fastener, a button, a snap, a magnet, or a tie.

Additionally or alternatively, in this or other embodiments the sleeve is formed of a non-flammable fabric.

Additionally or alternatively, in this or other embodiments the tether includes a breakaway feature.

Additionally or alternatively, in this or other embodiments the breakaway feature is a breakaway buckle.

Additionally or alternatively, in this or other embodiments the breakaway feature disconnects the sleeve from the elevator car as a result of a tether tension exceeding a threshold.

Additionally or alternatively, in this or other embodiments the load bearing member is a belt.

In yet another embodiment, a method of performing installation or maintenance on hoistway components for an elevator system includes installing a sleeve around a portion of a load bearing member of an elevator system, connecting the sleeve to a working platform via a tether, and performing one or more installation or maintenance operations at a first hoistway location via the working platform. The sleeve protects the load bearing member from damage from the one or more installation or maintenance operations.

Additionally or alternatively, in this or other embodiments the working platform is moved from the first hoistway location to a second hoistway location, and the sleeve is moved along the load bearing member via the tether connection between the sleeve and the working platform.

Additionally or alternatively, in this or other embodiments a connection of the sleeve to the working platform is broken by a breakaway element disposed at the tether.

Additionally or alternatively, in this or other embodiments the one or more installation or maintenance operations include one or more of welding or grinding.

Additionally or alternatively, in this or other embodiments the sleeve is formed from non-flammable material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
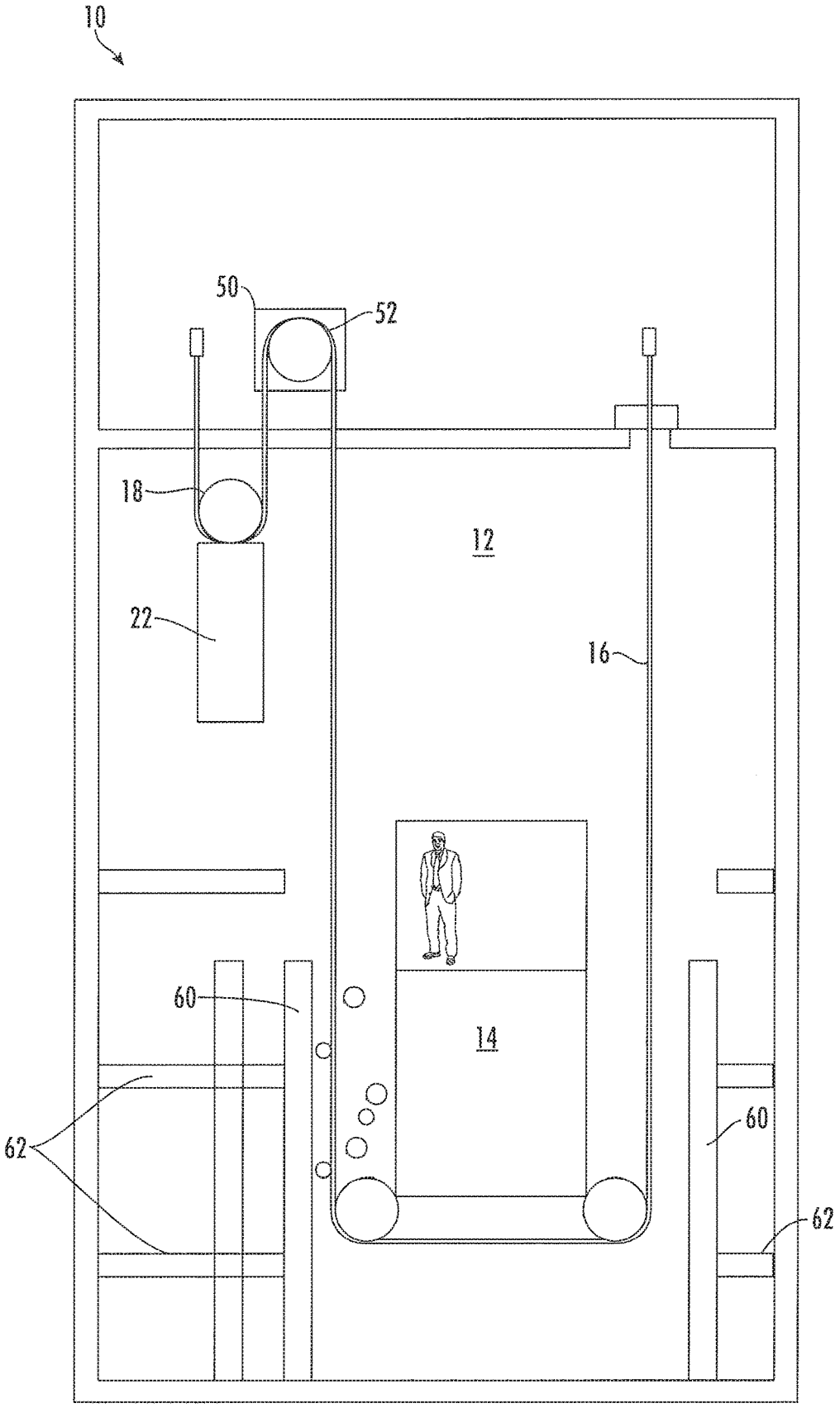
FIG. 1 is a schematic illustration of an embodiment of an elevator system.

Shown in FIG. 1 is a schematic view of an exemplary traction elevator system 10. The elevator system 10 includes an elevator car 14 operatively suspended or supported in a hoistway 12 with one or more belts 16. The elevator car 14 travels along the hoistway 12 along guide rails 60 extending along the hoistway. In some embodiments, the guide rails 60 are supported in the hoistway 12 by rail supports 62. The one or more belts 16 interact with sheaves 18 and 52 to be routed around various components of the elevator system 10. Sheave 18 is configured as a diverter, deflector or idler sheave and sheave 52 is configured as a traction sheave 52, driven by a machine 50. Movement of the traction sheave 52 by the machine 50 drives, moves and/or propels (through traction) the one or more belts 16 that are routed around the traction sheave 52. Diverter, deflector or idler sheaves 18 are not driven by a machine 50, but help guide the one or more belts 16 around the various components of the elevator system 10. The one or more belts 16 could also be connected to a counterweight 22, which is used to help balance the elevator system 10 and reduce the difference in belt tension on both sides of the traction sheave during operation. The sheaves 18 and 52 each have a diameter, which may be the same or different from each other. In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52.

The belts 16 are constructed to meet belt life requirements and have smooth operation, while being sufficiently strong to be capable of meeting strength requirements for suspending and/or driving the elevator car 14 and counterweight 22. Further, while the description herein utilizes the term "belt", one skilled in the art will readily appreciate that the present disclosure may be readily applied to other configurations of load bearing members, such as ropes.

Figure 2:
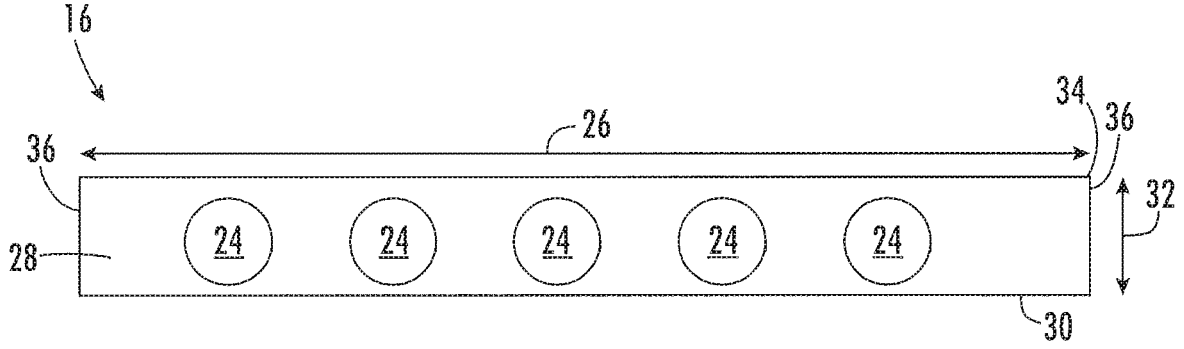
FIG. 2 is cross-sectional view of an embodiment of a belt for an elevator system.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket 28 to restrain movement of the tension members 24 in the belt 16 and to protect the tension members 24. The jacket 28 defines a traction side 30 configured to interact with a corresponding surface of the traction sheave 52.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While five tension members 24 are illustrated in the embodiment of FIG. 2, other embodiments may include other numbers of tension members 24, for example, 6, 10 or 12 tension members 24. Further, while the tension members 24 of the embodiment of FIG. 2 are substantially identical, in other embodiments, the tension members 24 may differ in construction from one another.

Figure 3A:
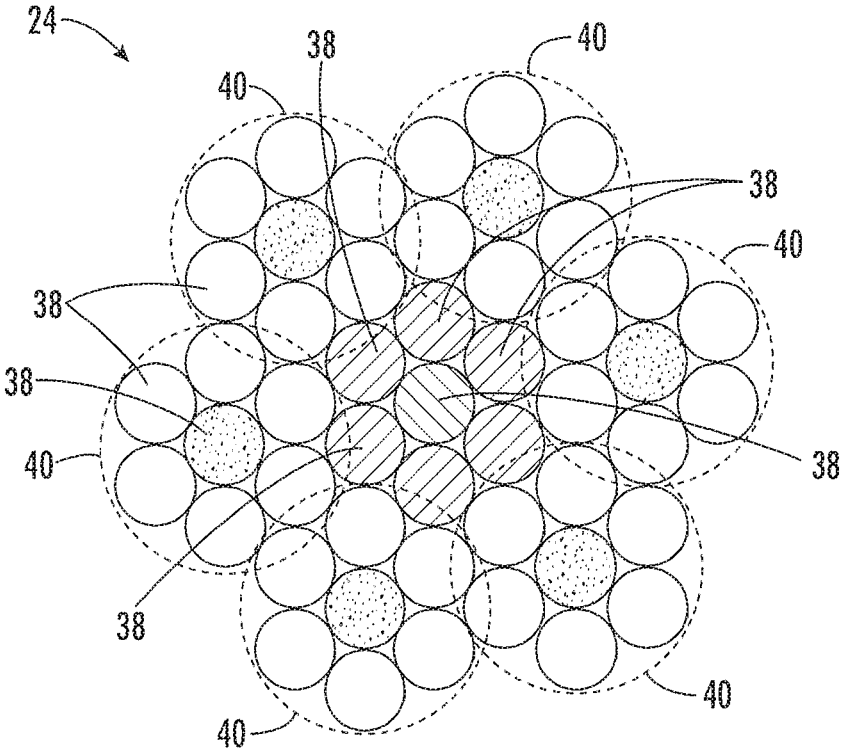
FIG. 3A is a cross-sectional view of an embodiment of a tension member of a belt.
Figure 3B:
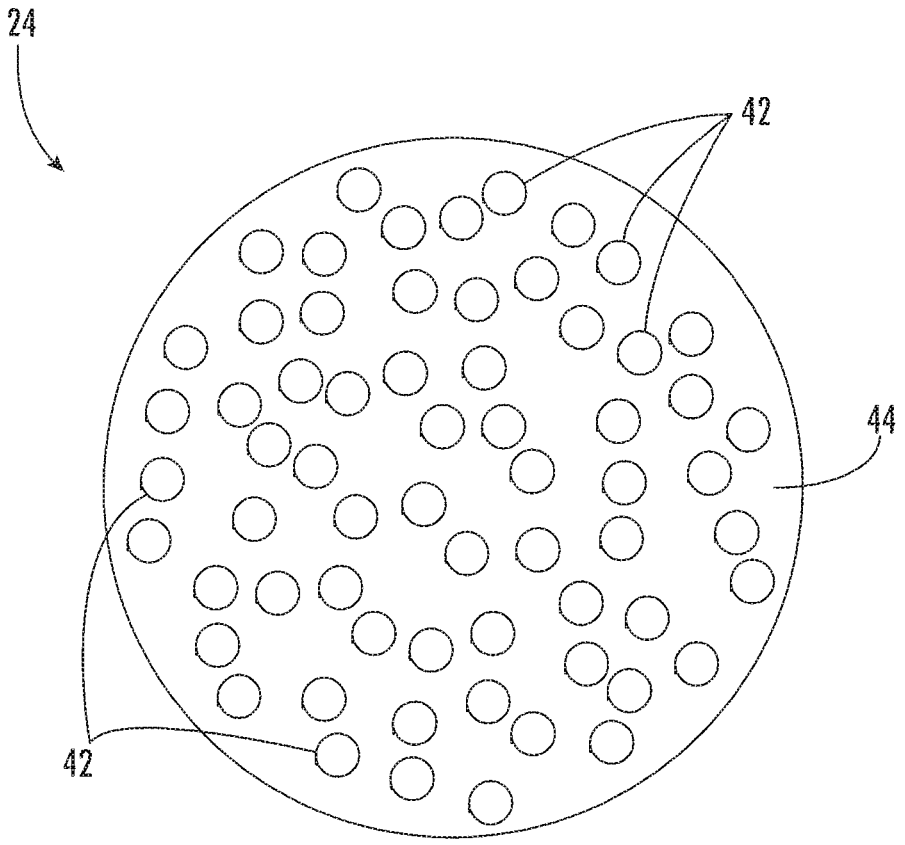
FIG. 3B is a cross-sectional view of another embodiment of a tension member of a belt.

Referring now to FIG. 3A, the tension member 24 may be a plurality of wires 38, for example, steel wires 38, which in some embodiments are formed into one or more strands 40. In other embodiments, such as shown in FIG. 3B, the tension member 24 may include a plurality of fibers 42, such as carbon fiber, glass fiber, basalt fiber, liquid crystal polymer fiber, or aramid fiber, disposed in a matrix material 44. Materials such as but no limited to polyurethane, vinyl ester, or epoxy may be utilized as the matrix material 44.

Referring again to FIG. 2, the jacket 28 may be formed from materials such as the elastomers of thermoplastic and thermosetting polyurethanes, thermoplastic polyester elastomers, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber, or combinations thereof. Other materials may be used to form the jacket 28 if they are adequate to meet the required functions of the belt 16. For example, a primary function of the jacket 28 is to provide a sufficient coefficient of friction between the belt 16 and the traction sheave 52 to produce a desired amount of traction therebetween. The jacket 28 should also transmit the traction loads to the tension members 24. In addition, the jacket 28 should be wear resistant and protect the tension members 24 from impact damage, exposure to environmental factors, such as chemicals, for example.

Figure 4:
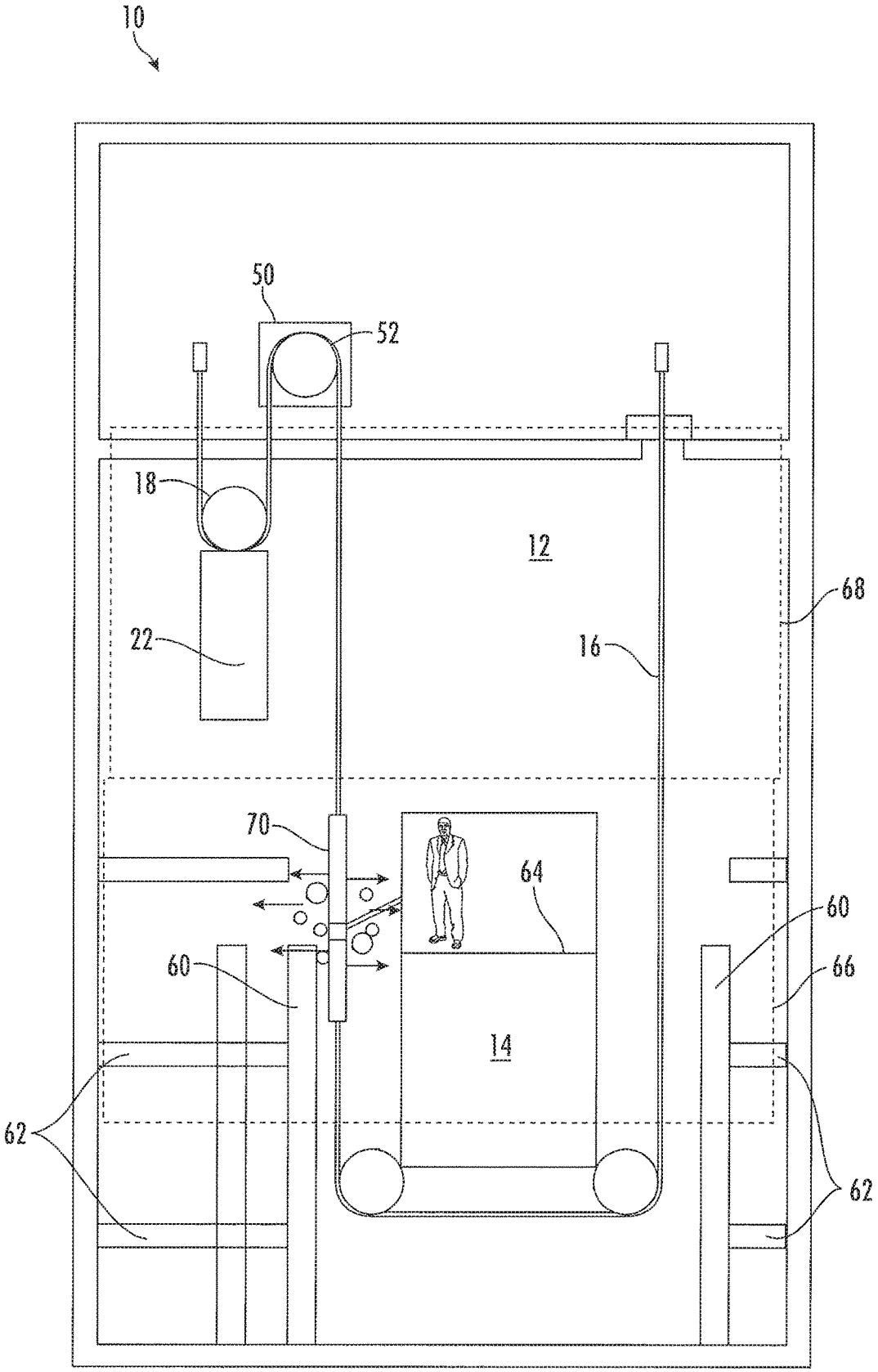
FIG. 4 is a schematic illustration of an embodiment of an elevator system including a protective sleeve.

Referring now to FIG. 4, in some embodiments the elevator car 14 is utilized as an installation/maintenance platform from which a technician installs/repairs components of the elevator system 10, such as guide rails 60, rail brackets 62 or the like in the hoistway 12. For example, the technician may use a car roof 64 of the elevator car as the working platform. In other embodiments, the technician may alternatively use a dedicated working vehicle. In such a method, the machine 50 and traction sheave 52 are installed in the hoistway 12, typically at a top of the hoistway 12. The counterweight 22 is then positioned at the top of its travel path in the hoistway 12. The elevator car 14 is positioned at a bottom of the hoistway 12, also referred to as a pit. Once the elevator car 14 is positioned, the belt or belts 16 are installed and routed over the traction sheave 52 and any other sheaves 18 of the elevator system 10, such that the elevator car 14 can now be moved along the hoistway by the belts 16 via the sheaves 18, 52.

Utilizing the working platform, the technician installs/repairs guide rails 60, rail brackets 62 and/or other hoistway components along a first hoistway portion 66. Once completed, the elevator car 14 is moved to the first hoistway portion 66 utilizing the guide rails 60 installed. The technician may then install guide rails 60, rail brackets 62 and/or other hoistway components at a second hoistway portion 68 above the first hoistway portion 66. The elevator car 14 may then be moved to the second hoistway portion 68. This process is repeated upward along the hoistway.

Figure 5:
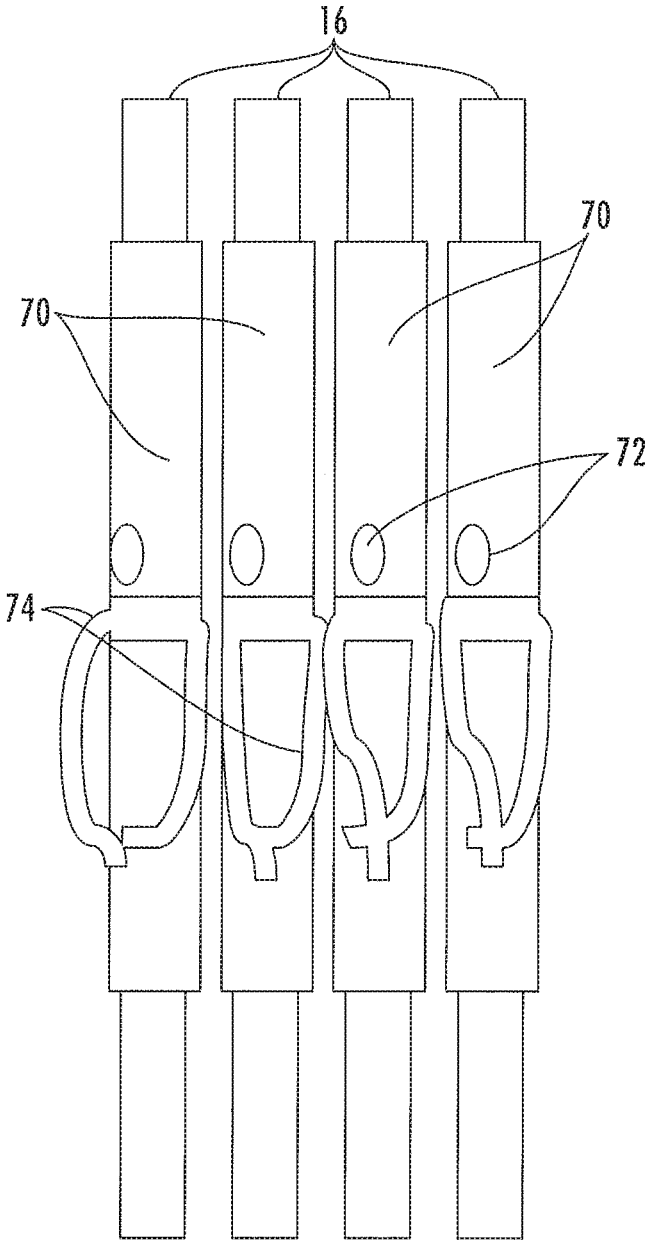
FIG. 5 is an illustration of an embodiment of an elevator load bearing member with a protective sleeve.

During installation/maintenance of the guide rails 60, rail brackets 62 and/or other hoistway components, the technician may perform processes such as welding or grinding which produce debris such as slag, chips, sparks, and the like, that may damage the belts 16, which are in close proximity to the work being performed. Referring now to FIG. 5, a belt sleeve 70 is installed over the belt 16 to protect the belt 16 from damage during installation/maintenance of hoistway components. The belt sleeve 70 extend partially along a length of the belt 16 and wrap around the belt 16. The belt sleeve 70 utilizes a closure 72 such as a hook and loop fastener, a button, a snap, a magnet, a tie, or the like to secure the belt sleeve 70 at the belt 16. Once installed, the belt sleeve 70 is slidable along the belt 16. The belt sleeve 70 is formed of a non-flammable fabric, such as a fiberglass fabric, and may include other elements such as impact resistant materials, such as Kevlar, Silica fabric, Nomex Aramid fabric or the like.

Figure 6:
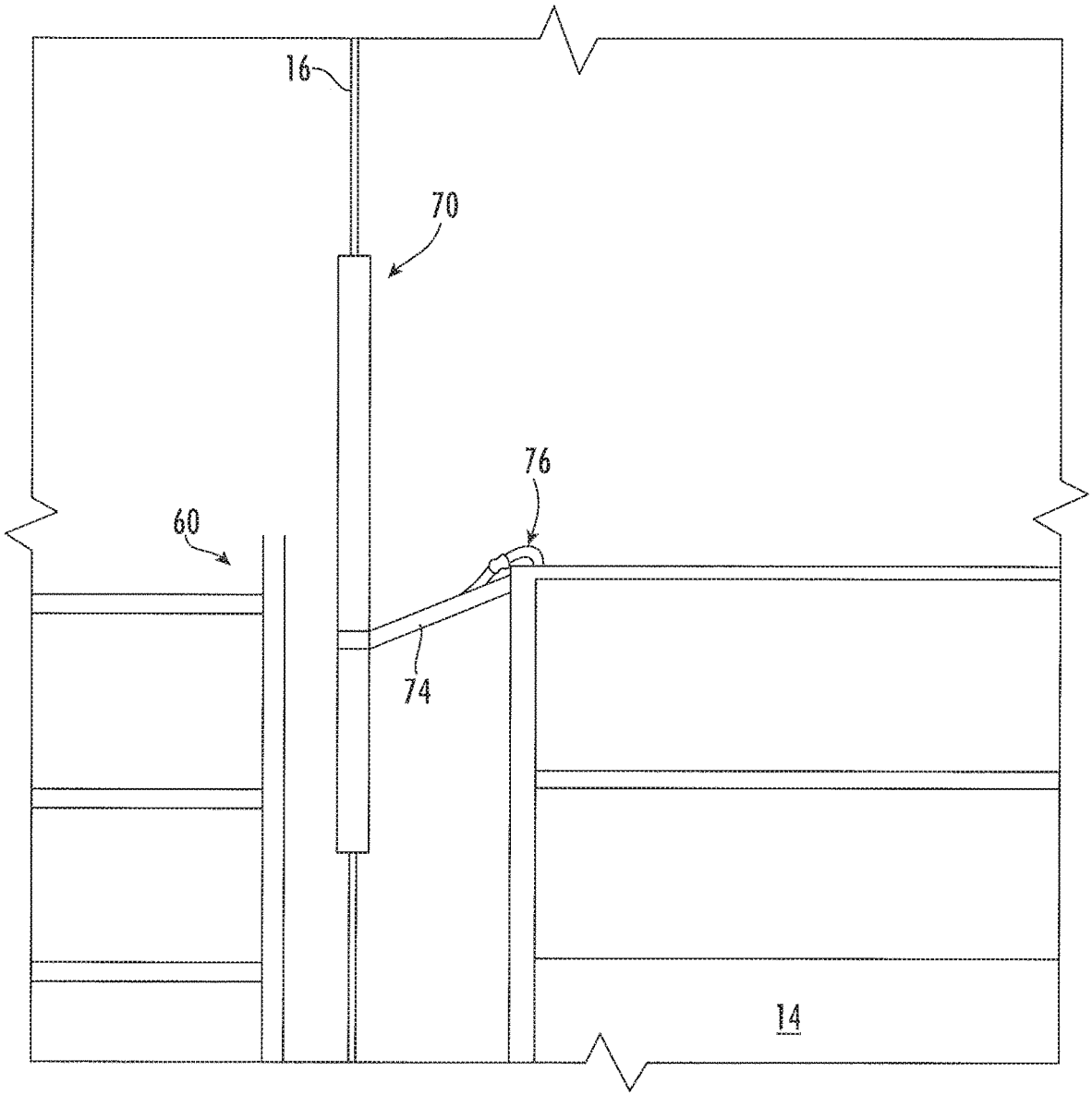
FIG. 6 is an illustration of an embodiment of a connection of a protective sleeve to an elevator car.

In elevator systems 10 with multiple belts 16, such as shown in FIG. 5, each belt 16 is enclosed by an individual belt sleeve 70. Alternatively, in other embodiments, a belt sleeve 70 may enclose more than one belt 16. Each belt sleeve 70 includes a tether 74 to connect the belt sleeve 70 to the elevator car 14, as illustrated in FIG. 6. Connecting the belt sleeve 70 to the elevator car 14 allows the belt sleeve 70 to slide along the belt 16 as the elevator car 14 moves along the hoistway 12 during the installation process, so the belt sleeve 70 protects the portion of the belt 16 in proximity to the installation processes being performed by the technician. In some embodiments, a length of the tether 74 is adjustable to accommodate various hoistway sizes and layouts.

The belt sleeve 70 further includes a breakaway feature, such as a breakaway buckle 76 along the tether 74. If the tension on the tether 74 increases to above a threshold, the breakaway buckle 76 will open, thus severing the tether connection between the belt sleeve 70 and the elevator car 14. Utilizing a breakaway feature such as the breakaway buckle 76 prevents damage to the belts 16 during the installation process if, for example, the belt sleeve 70 resists sliding along the belt 16 or if a force is applied to the tether 74 increasing its tension.

The belt sleeve 70 disclosed herein provides protection to the belts 16 during installation and/or maintenance of hoistway components. The belt sleeve 70 aids in ensuring the robust quality and life expectancy of the belt 16 by preventing damage to the belt 16 from processes such as welding or grinding in the hoistway that causes premature belt failure and costly belt replacements. The location of the guide rails 60 can vary depending on the layout of the elevator system. Therefore the belt protection needs to be flexible, adjustable and easy to apply. The belt sleeve 70 disclosed herein fits a wide range of belt sizes, can be utilized with a wide variety of elevator system layouts and configurations. Further, the belt sleeve 70 is configured to move along the belt 16 and is easy to install at the belt 16.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A protective cover for a load bearing member of an elevator system, comprising:

a sleeve wrapped around a perimeter of the load bearing member, the sleeve configured to protect the load bearing member from debris damage during installation or maintenance operation of the elevator system, and configured to slide along a length direction of the load bearing member; and a tether configured to extend from the sleeve to a working platform, thereby connecting the sleeve to the working platform;

wherein the sleeve is formed of a non-flammable fabric.

2. The protective cover of claim 1, further comprising a closure to secure the sleeve at the load bearing member.

3. The protective cover of claim 2, wherein the closure is one of a hook and loop fastener, a button, a snap, a magnet, or a tie.

4. The protective cover of claim 1, wherein the tether includes a breakaway feature.

5. The protective cover of claim 4, wherein the breakaway feature is a breakaway buckle.

6. An elevator system, comprising:

a hoistway;

an elevator car disposed in the hoistway;

an elevator load bearing member operably connected to the elevator car to suspend and/or drive the elevator car along the hoistway;

a guide rail installed in the hoistway to guide movement of the elevator car along the hoistway; and a protective cover for the load bearing member, the protective cover including:

a sleeve wrapped around a perimeter of the load bearing member, the sleeve configured to protect the load bearing member from debris damage during installation or maintenance operation of the elevator system, and configured to slide along a length direction of the load bearing member; and a tether extending from the sleeve to the elevator car, thereby connecting the sleeve to the elevator car;

wherein the sleeve is formed of a non-flammable fabric.

7. The elevator system of claim 6, further comprising a closure to secure the sleeve at the load bearing member.

8. The elevator system of claim 6, wherein the closure is one of a hook and loop fastener, a button, a snap, a magnet, or a tie.

9. The elevator system of claim 6, wherein the tether includes a breakaway feature.

10. The elevator system of claim 9, wherein the breakaway feature is a breakaway buckle.

11. The elevator system of claim 9, wherein the breakaway feature disconnects the sleeve from the elevator car as a result of a tether tension exceeding a threshold.

12. The elevator system of claim 6, wherein the load bearing member is a belt.

13. A method of performing installation or maintenance on hoistway components for an elevator system, comprising:

installing a sleeve around a portion of a load bearing member of the elevator system;

connecting the sleeve to a working platform via a tether extending from the sleeve to the working platform; and performing one or more installation or maintenance operations at a first hoistway location via the working platform, the sleeve protecting the load bearing member from damage from the one or more installation or maintenance operations;

wherein the sleeve is formed of a non-flammable fabric.

14. The method of claim 13, further comprising:

moving the working platform from the first hoistway location to a second hoistway location; and moving the sleeve along the load bearing member via the tether connection between the sleeve and the working platform.

15. The method of claim 13, further comprising breaking a connection of the sleeve to the working platform by a breakaway element disposed at the tether.

16. The method of claim 13, wherein the one or more installation or maintenance operations include one or more of welding or grinding.

* * * * *